US006735792B2

(12) United States Patent
Johansson

(10) Patent No.: US 6,735,792 B2
(45) Date of Patent: May 18, 2004

(54) APPLIANCE FOR SHOWERING AND BATHING

(76) Inventor: Paul-Johnny Johansson, P.O. Box 508, Hinsdale, IL (US) 60522-0508

( * ) Notice: Subject to any disclaimer, the term of this patent is extended or adjusted under 35 U.S.C. 154(b) by 0 days.

(21) Appl. No.: 10/092,271

(22) Filed: Mar. 6, 2002

(65) Prior Publication Data

US 2002/0124305 A1 Sep. 12, 2002

(30) Foreign Application Priority Data

Mar. 7, 2001 (DE) ..... 101 10 714

(51) Int. Cl.[7] ..... A47K 3/02
(52) U.S. Cl. ..... 4/556
(58) Field of Search ..... 4/555, 556, 538

(56) References Cited

U.S. PATENT DOCUMENTS

| | | | | |
|---|---|---|---|---|
| 2,991,482 A | * | 7/1961 | Brass | 4/556 |
| 4,118,810 A | | 10/1978 | Brickhouse et al. | |
| 4,561,160 A | | 12/1985 | Nicol et al. | |
| 4,706,311 A | * | 11/1987 | Jarosinski | 4/546 |
| 5,184,358 A | | 2/1993 | Gruidel et al. | |
| 5,813,062 A | * | 9/1998 | Vago et al. | 4/556 |
| 6,151,727 A | * | 11/2000 | Lofquist, Jr. | 4/555 |

FOREIGN PATENT DOCUMENTS

| | | | | |
|---|---|---|---|---|
| EP | 0457093 A1 | | 11/1991 | |
| EP | 0457093 | * | 11/1991 | 4/556 |
| GB | 0966417 | | 8/1964 | |
| GB | 2029211 A | | 3/1980 | |

OTHER PUBLICATIONS

Badsoffan™ Standard from Easy Bath AB.

* cited by examiner

*Primary Examiner*—Charles E. Phillips
(74) *Attorney, Agent, or Firm*—Tarolli, Sundheim, Covell & Tummino L.L.P.

(57) ABSTRACT

The present invention relates to an appliance for showering and bathing, said appliance (1) incorporating a tub (2) which stands on a floor (4) or the like. The tub (2) has a reclining and/or sitting surface (5) for a bather (P) and a door opening (6) through which said bather (P) can move or be moved to or from the reclining and/or sitting surface (5). A door (7) is arranged so as to seal the door opening (6) whenever said bather (P) is in the tub (2). The reclining and/or sitting surface (5) is situated at a height (H) above the floor (4) or the like that is the same, or substantially the same, as the normal height (H) of a seat surface (8) of a chair (9*a*) or piece of transportation equipment (9*b*). The door (7) is arranged so as to be swung upwards or to be removable from the tub (2) in order to open up the door opening (6), and the tub (2) cannot substantially be tilted and/or raised and lowered, but may possibly be finely adjusted in said directions.

37 Claims, 6 Drawing Sheets

APPLIANCE FOR SHOWERING AND BATHING

FIELD OF THE INVENTION

The present invention relates to an appliance for showering and bathing, said appliance comprising a tub which stands on a floor or the like, the tub having a reclining and/or sitting surface for a bather, and the tub having a door opening through which said bather can move or be moved to or from the reclining and/or sitting surface, and a door being arranged so as to seal the door opening whenever the bather is in the tub.

BACKGROUND OF THE INVENTION

Showering and bathing appliances of the aforementioned type are known by the name "Badsoffan"™ ("bathing sofa") and are sold by a Swedish firm. According to a brochure the "Badsoffan"™ appliance is constructed in such a way that maneuvering the bather into and out of it is straightforward. To accomplish this, a door opening is arranged in the appliance and a reclining and/or sitting surface is arranged higher above the floor than normal. The appliance has a door to enable the door opening to be sealed, and this door is adapted to be lowered beneath the door opening to enable the door to be opened. However, lowering the door produces a number of crucial drawbacks. One drawback is the fact that the door must have room beneath the door opening and this has been achieved at the expense of the height of the appliance above the reclining and/or sitting surface, with the result that the water level that can be obtained in the appliance is unsatisfactory. Another drawback is the fact that when it is in its lowered position, the door prevents there from being a free space beneath the reclining and/or sitting surface into which it is for example possible to maneuver one's legs in order to more easily be able to get up from the reclining and/or sitting surface more easily, or into which the underframe of a piece of transportation equipment can be maneuvered in order to facilitate the transfer of a bather from the transportation equipment onto the reclining and/or sitting surface, or vice versa.

Another appliance of the aforementioned type is known from GB 2 029 211. This appliance has a door opening and a door that can be swung upwards to open up the door opening. The tub of the appliance is arranged on a pedestal-type stand and it can be fastened on the pedestal in a way that allows it to be tilted, with the result that some of the bathwater that is let in at the foot end of the tub can be made to flow from the foot end into the head end of the tub by tilting the tub. However, the tilting device and the pedestal-type construction has, inter alia, the drawback that the cost of manufacturing the showering and bathing appliance is high. A further drawback is the fact that the pedestal-type construction ties up substantial parts of a space beneath the tub.

SUMMARY OF THE INVENTION

It is the aim of the present invention to eliminate the aforementioned drawbacks, and this is accomplished by virtue of the fact that the appliance primarily incorporates the characterizing features apparent from claim 1 given below.

The fact that the appliance incorporates the stated characterizing features makes it easy for a bather to move or be moved onto the reclining and/or sitting surface of the tub or out of the tub, enables a larger space to be disposed beneath the tub which can be used for various purposes, and allows the appliance to be manufactured cheaply.

BRIEF DESCRIPTION OF THE DRAWINGS

The invention will now be explained in more detail with reference to the accompanying drawings, wherein.

DETAILED DESCRIPTION OF THE INVENTION

Figure 1:
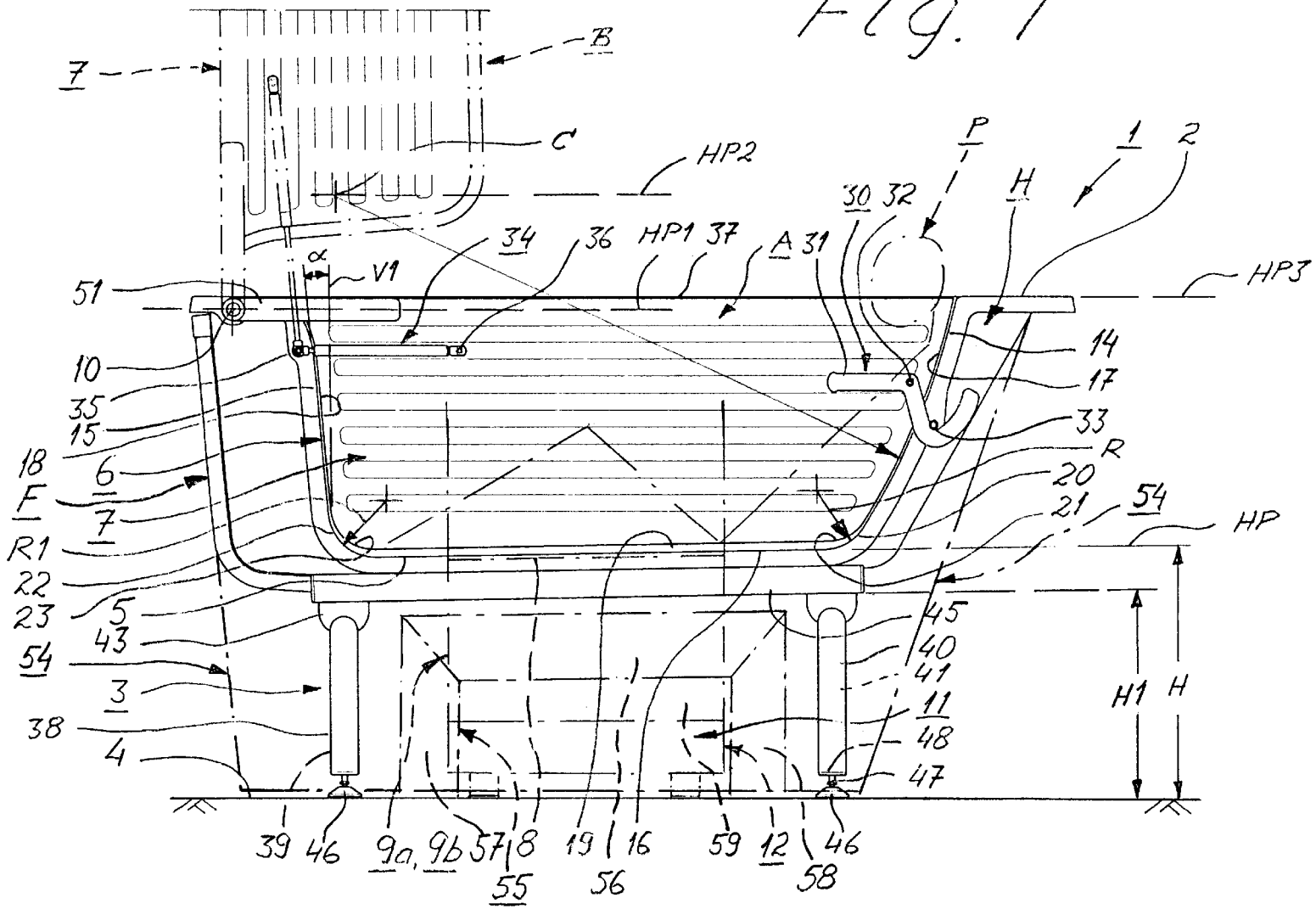
FIG. 1 shows a side view of the appliance according to the invention.

The drawings depict an example of an appliance 1 in accordance with the invention, in which a shower may be taken for the purposes of personal hygiene and in which a bath may be taken in order to relax. This appliance 1 contains a tub 2 and a stand 3 on which the tub 2 is arranged and which rests on a floor 4 or the like. The tub 2 has a reclining and/or sitting surface 5 for the person P who is bathing or being bathed, a door opening 6 through which said bather P can move or be moved to and from the reclining and/or sitting surface 5, and a door 7 for closing off the door opening 6 when the bather P is in the tub 2.

The tub 2 has a foot end F for the feet of the bather P and a head end HA for the upper body of the bather P.

The reclining and/or sitting surface 5 of the tub 2 is arranged at a height H above the floor 4 or the like and this height H corresponds to a normal height H above the floor 4 or the like of a seat surface 8 of a chair 9*a* or of a piece of transportation equipment 9*b* which can be transported to and from the appliance 1 with said bather P sitting on said seat surface 8. This enables the bather P to move or be moved between two surfaces 5 and 8 located at the same or substantially the same height. The chair 9*a* and the piece of transportation equipment 9*b* are depicted schematically by dotted lines in FIG. 1, and the piece of transportation equipment 9*b* may for example be a wheelchair or other carrying chair, a patient trolley or a patient lifting device.

The reclining and/or sitting surface 5 is arranged at a height H above the floor 4 or the like such that a bather P standing on the floor 4 is able to sit down or be set down backwards onto the reclining and/or sitting surface 5 without having to really bend the knees and thereafter is able to lift the legs onto the reclining and/or sitting surface 5 by raising the legs and twisting the body.

The door 7 of the tub 2 is adapted to be swung vertically upwards about a horizontal shaft 10 from a bottom position A, in which it seals the door opening 6, into a top position B in which it opens up the door opening 6. In FIG. 1 the door 7 is shown in the bottom position A by solid lines, and only in part in the top position B by dotted lines. Alternatively, the door 7 may be removable from the tub 2 in order to open up the door opening 6.

In order to provide an efficient design in terms of cost, the tub 2 may essentially be arranged fixedly on the stand 3, i.e. the tub 2 is not substantially adapted to be tilted and/or raised and lowered, but may possibly be adjustable. What is meant by adjustable in this context is that the tub 2 is adapted to be slightly tilted and/or raised or lowered in order to move it into a convenient position in relation to the stand 3 or to the floor 4 or the like. Once the adjustment has been carried out, the tub 2 can for instance be locked in the position selected.

Since the door 7 is adapted to be swung upwards out of the bottom position A in which It seals the door opening 6, or to be removed from the tub 2, but is not lowered downwards, this creates room for a free space 11 beneath the reclining and/or sitting surface 5. An underframe 12 of the transportation equipment 9*b* can be maneuvered into this space 11 and/or a bather P seated on the reclining and/or sitting surface 5 can position their legs in the space 11 so as to be able to place their feet against the floor 4 underneath the reclining and/or sitting surface 5, thereby enabling the bather P to more easily raise himself or herself up from the sitting position theron.

Figure 2:
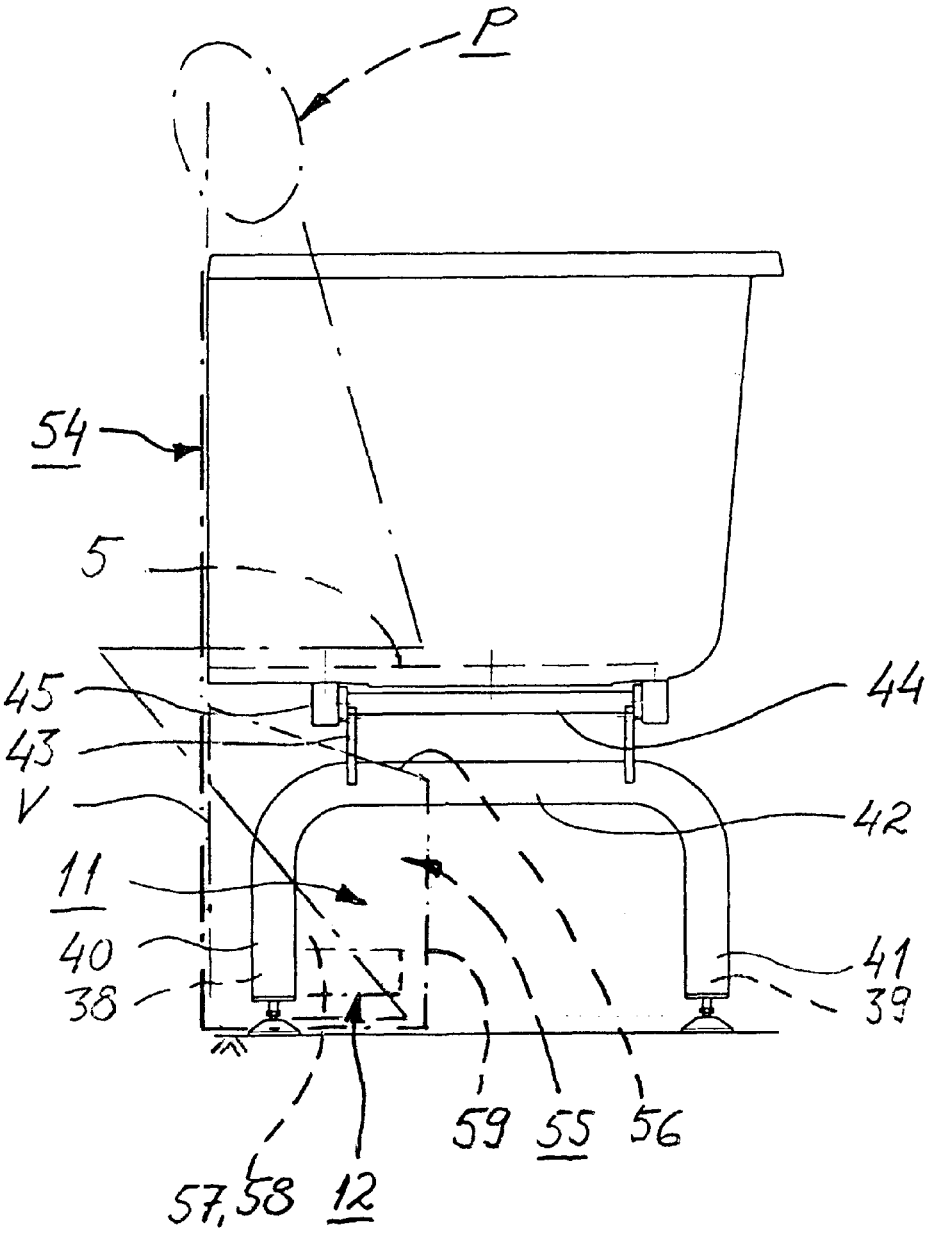
FIG. 2 shows the appliance seen in FIG. 1 from the front.
Figure 3:
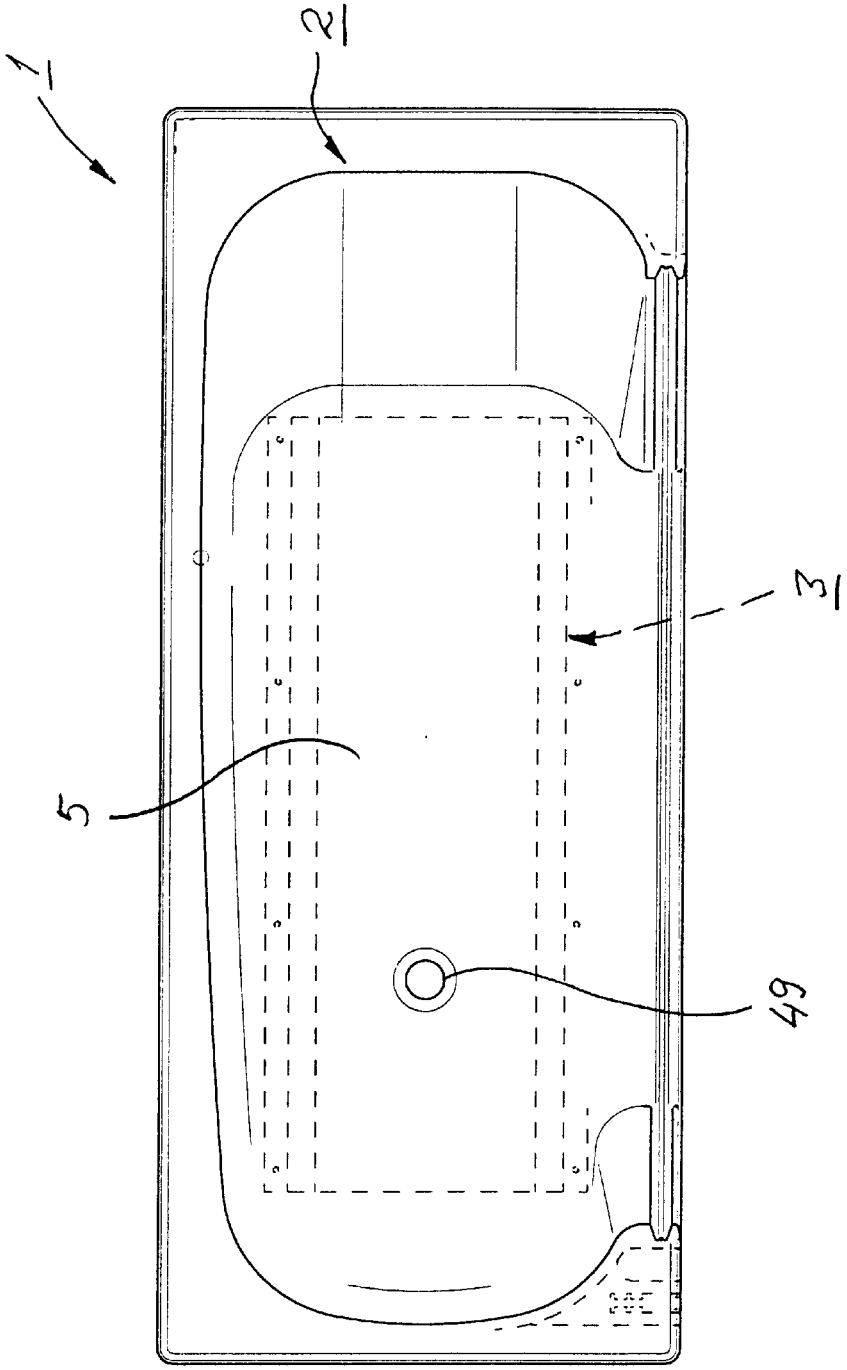
FIG. 3 shows the appliance seen in FIG. 1 from above.
Figure 4:
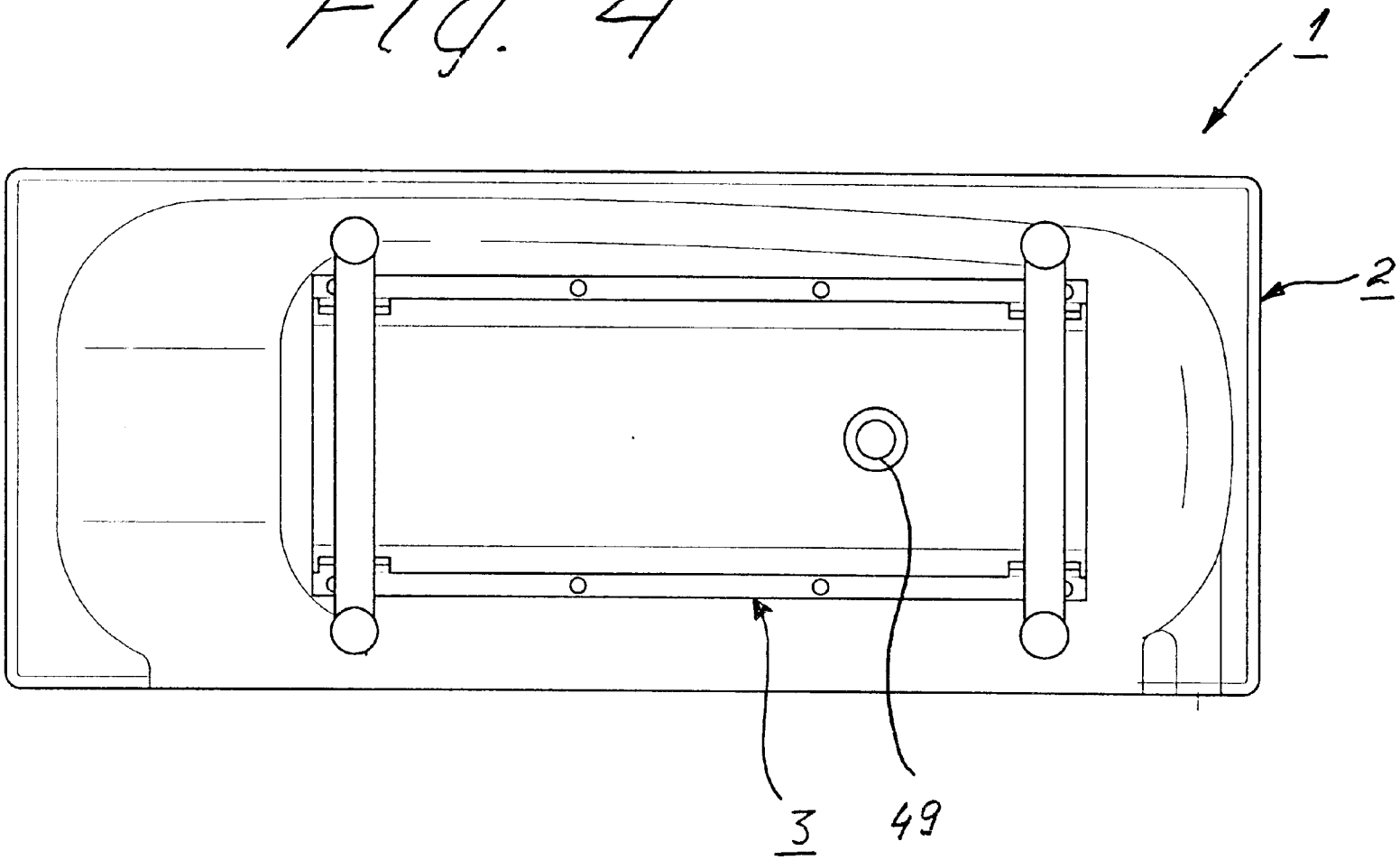
FIG. 4 shows the appliance seen in FIG. 1 from below.
Figure 5:
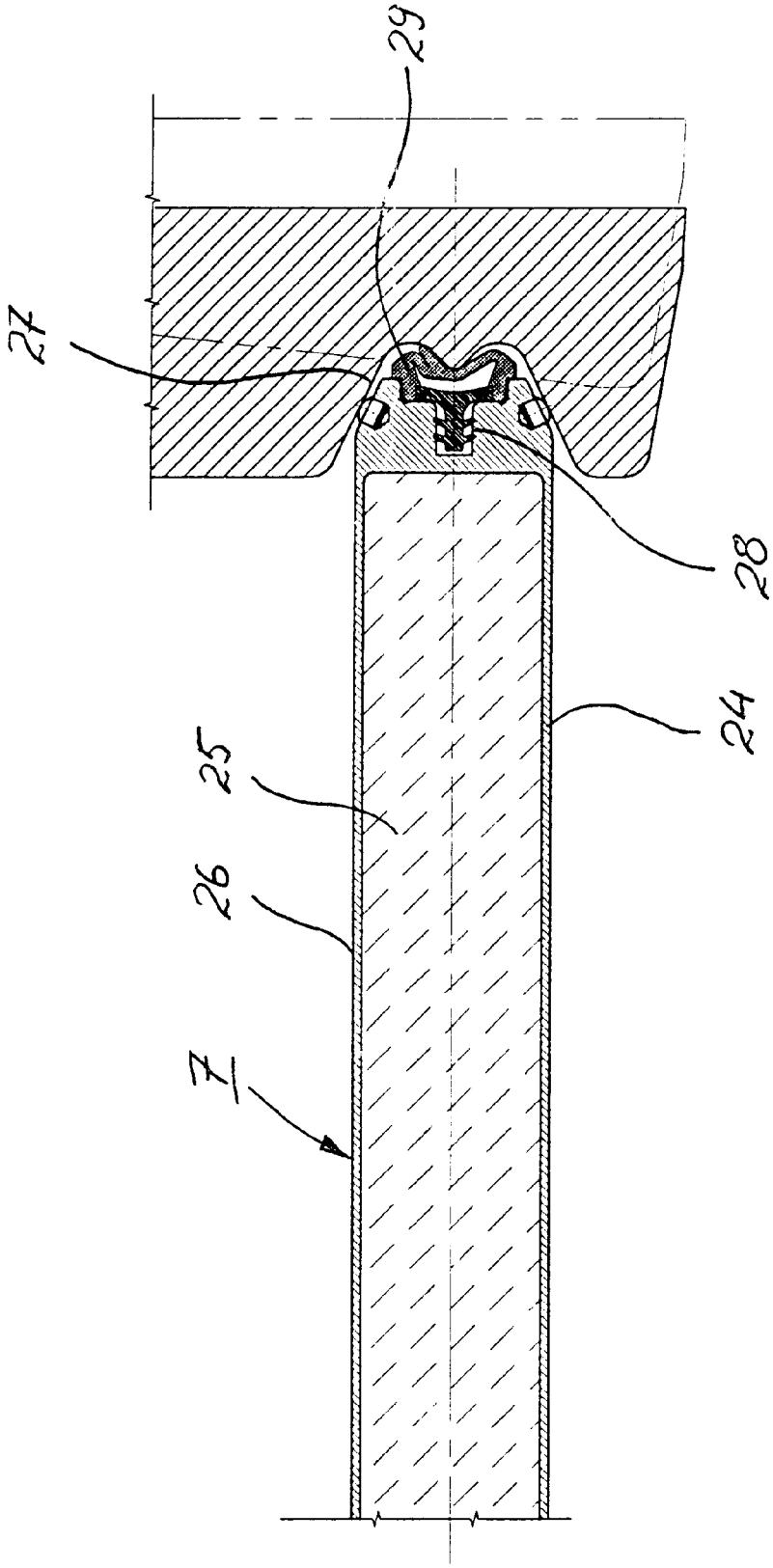
FIG. 5 shows a section taken through parts of the appliance seen in FIG. 1.
Figure 6:
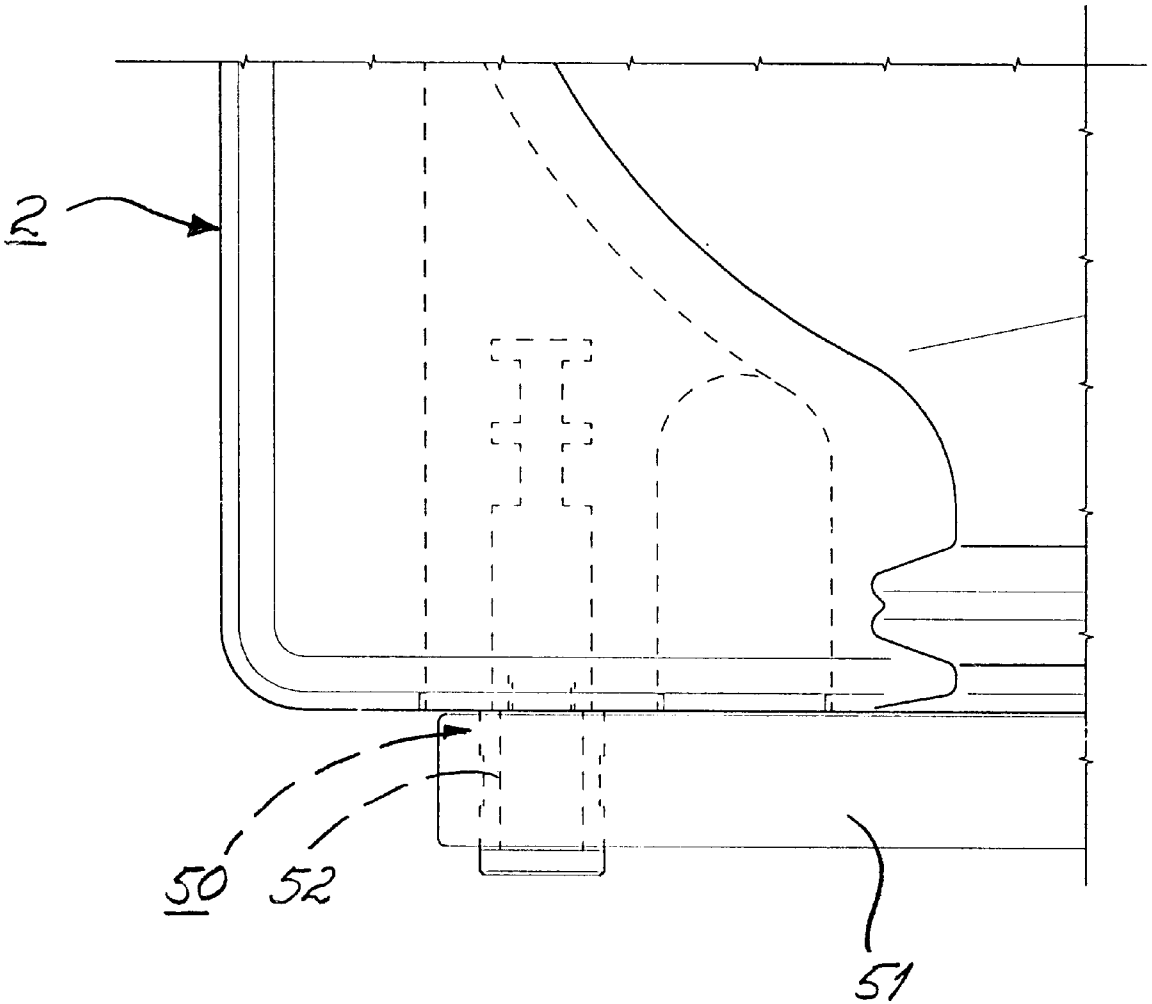
FIG. 6 shows parts of the appliance seen in FIG. 1 from above.

In FIG. 2 the dotted lines schematically indicate parts of an underframe 12 which has been maneuvered into the space 11, and also parts of a bather P who has positioned their legs in said space 11 and placed their feet on the floor 4 beneath the reclining and/or sitting surface 5. FIG. 2 also shows that the space 11 is so arranged that the underframe 12 can be maneuvered thereinto until it is behind a vertical plane V in which a front edge 13 of the reclining and/or sitting surface 5 is situated. It can also be seen from FIG. 2 that the space 11 is so arranged that the bather P seated on the reclining and/or sitting surface 5 is able to place their feet on the floor 4 to the rear of said vertical plane V.

The space 11 preferably extends from the floor 4 or the like up into the vicinity of the tub 2. This means that the height H1 of the space 11 is only a little less than the height H from the floor 4 or the like to the reclining and/or sitting surface 5. The space 11 preferably extends along at least substantial parts of an underside of the door opening 6 and is, when viewed from the side towards the door opening 6 in the tub 2, rectangular or substantially rectangular.

The door opening 6 preferably has a first short side 14, a second short side 15 and an underside 16. This underside 16 and the reclining and/or sitting surface 5 are preferably situated in the same or substantially the same horizontal plane HP. The second short side 15 is disposed in proximity to the foot end F of the tub 2 and in proximity to the horizontal shaft 10.

The door opening 6 may incorporate an underside 16 which, viewed from the side facing the tub 2, is straight or substantially straight and is situated in a horizontal plane HP or substantially in a horizontal plane HP. The tub 2 may have top edges 37 which, viewed from the side facing the tub 2, are straight or substantially straight and which run in a horizontal plane HP3 or substantially in a horizontal plane HP3 and are parallel or substantially parallel to the underside 16 of the door opening 6.

The door 7 has a first short side 17 which is provided to cooperate with the first short side 14 of the door opening 6 when the door 7 seals the door opening 6. The door 7 has a second short side 18 which is provided to cooperate with the second short side 15 of the door opening 6 when the door 7 seals the door opening 6, and in addition the door 7 has an underside 19 which is provided to cooperate with the underside 16 of the door opening 6 when the door 7 seals the door opening 6.

The first short side 14 of the door opening 6 is in the shape of an arc whose center C lies in a horizontal plane HP2 above the tub 2, and the first short side 17 of the door 7 is in the shape of an arc which conforms to the arcuate shape of the first short side 14 of the door opening 6.

The shaft 10 is preferably situated in the first horizontal plane HP1.

A first corner 20 of the door opening 6 between the first short side 14 thereof and an underside 16 thereof is in the shape of an arc whose radius R lies within the 50 to 150 mm range and is preferably 85 mm or substantially 85 mm. A corresponding corner 21 of the door 7, between the second short side 18 of the door 7 and an underside 19 thereof, is in the shape of an arc whose radius conforms to the radius R of the first corner 20 of the door opening 6.

A second corner 22 of the door opening 6, between the second short side 15 thereof and an underside 16 thereof, is in the shape of an arc whose radius R1 lies within the 50 to 150 mm range and is preferably 85 mm or substantially 85 mm. A corresponding second corner 23 of the door 7, between the second short side 18 and an underside 19 thereof, is in the shape of an arc whose radius conforms to the radius R1 of the second corner 22 of the door opening 6.

An angle $\alpha$ between the second short side 15 of the door opening 6 and a vertical plane VI is no more than 15 degrees, and preferably 5 degrees or substantially 5 degrees. The corresponding second short side 18 of the door 7 forms a corresponding angle $\alpha$ with said vertical plane VI.

The door 7 incorporates a door leaf of sandwich-type construction which has three layers 24, 25 and 26, viz. two outer layers 24, 26 made of reinforced plastic and an inner layer 25 of polyurethane foam or the like, which is arranged between these outer layers 24, 26. Since the door leaf is a sandwich-type construction and may be made of the specified or a similar material, it can have a maximum overall weight of 8 kg. The door 7 may be of this design both if it is mounted so as to swing on the tub 2 and if it can be removed therefrom.

On at least the first and second short side 17, 18, the door 7 may have parts 28, 29 which cooperate with parts 27 of the door opening 6 in such a way, when the door 7 seals the door opening 6, that they prevent the door 7 from being pressed out of the door opening 6 when the latter is under load from the water in the tub 2. In addition, the respective parts 27, 28 and 29 of the door 7 and door opening 6 may be so constructed that they bear tightly against one another when the door 7 seals the door opening 6, so as to obtain a water-tight or substantially water-tight joint between the door 7 and tub 2. Said parts 27 of the door opening 6 may incorporate a channel 27 and said parts 28, 29 of the door 7 may incorporate a channel 28 into which a sealing strip 29 engages. The door 7 and the sealing strip 29 of the door 7 may engage in the channel 27 of the door opening 6 when the door 7 seals the door opening 6 and the sealing strip 29 bears tightly against sides of the channel 27.

The door opening 6 and the door 7 may also incorporate identical parts 27, 28 and 29 on their undersides 16, 19, and these parts may cooperate with one another so as to achieve a tight joint between the door opening 6 and the door 7. In lieu of a deep channel 27, however, the underside 16 of the door opening 6 may incorporate a shallow or substantially shallow part 27, with the result that in the underside 16 of the door opening 6 there is no substantial channel in which water can collect.

The door opening 6 and the door 7 are preferably substantially in the shape of a parallelepipedon, and the undersides 16, 19 thereof are straight or substantially straight. In addition, the underside 16 of the door opening 6 is preferably horizontal or substantially horizontal and also the reclining and/or sitting surface 5 of the tub 2 is preferably a plane or substantially plane and horizontal or substantially horizontal arrangement. The underside 16 of the door opening 6 and the reclining and/or sitting surface 5 of the tub 2 are preferably situated on the same or substantially the same level above the floor 4 or the like.

The tub 2 preferably has a maximum length of 1600 mm ±20% and a maximum width of 700 mm ±20%, and upper parts of the door opening 6 and of the door 7 preferably have a maximum length of 1200 mm ±20%, with the door opening 6 being shorter at the bottom than at the top. The door opening 6 and the door 7 preferably have a maximum height of 450 mm ±20%.

The reclining and/or sitting surface 5 is preferably arranged at a height of 450 mm ±20% above the floor 4 or the like, and the tub 2 has a total height of 900 mm ±20% from the floor 4 or the like as far as the top edges 37 of the tub 2. Viewed from the side nearest the tub 2, these top edges 37 are preferably straight and are preferably situated in a horizontal plane HP3.

A locking device 30 is arranged in order to keep the door 7 in the closed position. This locking device 30 may be variously constructed and arranged. In the depicted example the locking device 30 is arranged at the first short sides 14, 17 of the door opening 6 and the door 7, and it consists of a lever 31 which is swivel-mounted on the door 7 by means of a horizontal shaft 32 and which is able to operate via a shaft 33 on the tub 2.

The locking device 30 may be so constructed that it exerts pressure on the sealing strips 29 when it locks the door 7 in relation to the tub 2.

A counterbalancing device 34, for example at least one gas operated spring, has an end portion which is arranged on the tub 2 so as to swivel by means of a bearing 35, and an opposing end portion which a bearing 36 connects to the door 7 in a manner that allows it to swivel. This counterbalancing device 34 is provided for counterbalancing the door 7, so as to facilitate the adjustment thereof and to ensure that it cannot fall out.

The stand 3 for the tub 2 may be variously constructed. The stand 3 shown in the drawings has four legs 38 to 41, which are arranged vertically. The legs 38 to 41 are arranged in pairs and the legs of each pair of legs are joined to one another at the top by a connecting element 42 which runs at right angles in relation to the tub 2. At the top each such connecting element 42 has two mounting elements 43 on which are arranged a plurality of parts 44 which run at right angles to the tub 2. Arranged on the transverse parts 44 are parts 45 which run longitudinally in relation to the tub 2, and the tub 2 is arranged on said parts 45.

The legs 38 to 41 have feet 46 which stand on the floor 4. These feet 46 have a threaded pin 47 which is screwed into a threaded part 48 in the legs 38 to 41, thereby enabling the height H of the tub 2 to be finely adjusted above the floor 4 or the like.

The appliance 1 preferably does not have any water supply devices, for instance taps, water mixers, shower fixtures or the like for feeding in water for bathing or showering, which means that the design of the appliance is a straightforward one. Instead, such water supply devices may for example be arranged on a wall against which the tub 2 stands. On the other hand, the tub 2 does of course have a drainhole 49 for bathwater and may have an overflow at the top (not shown) in order to prevent water from running over the top edges 37.

A retaining device 50 for holding the door 7 on the tub 2 may for example have an arm 51 on the door 7. This arm 51 may be swivel-mounted, either directly or by means of a sleeve, onto a pin 52 which is screwed down on the tub 2.

An internal width of the head end HA of the tub 2 may be greater than an internal width of the foot end F of the tub 2.

Its simple design and compact form enable the appliance 1 to be used in many ways, e.g. in private dwellings and/or care homes and/or convalescence homes and/or hospitals, and in particular for elderly persons and/or persons in need of care and/or for the disabled and/or invalids, with each appliance 1 being allocated to one person or to persons residing together.

The appliances 1 can preferably be employed for the personal use of residents of apartments or rooms in homes or institutions. This allows the appliances 1 to replace central baths of the type usual in homes or institutions for the use of some or all residents.

The appliance 1 having the design outlined above or a similar design may be manufactured by fitting a tub 2 that has no door opening 6 with such an opening. This then allows the modified tub 2 to be equipped with a door 7 in order to be able to seal the door opening 6. The modified tub 2 can be equipped with extendable legs to enable the tub 2 and its reclining and/or sitting surface 5 to be raised by as much as 450 mm ±20%.

The design of the appliance 1 outlined above and illustrated in the drawings may be varied within the scope of the claims. It may be specified that the tub can for example be made of a suitable polymer or other suitable material. The stand 3 may consist of tubes or incorporate tubes made of a suitable material, but it is not absolutely necessary to use a stand, and instead the tub may incorporate only legs or be arranged on a raised area of the floor.

As indicated by dotted lines in FIGS. 1 and 2, the front face of the tub 2 may have a screen wall 54 (the so-called panelling) which screens off at least the underframe and the legs 38 to 41 from the front. This screen wall 54 may incorporate a well 55 which extends rearwards towards the underframe and constitutes the space 11. This well 55 may taper towards the rear and is preferably constituted by a top face 56, two side walls 57, 58 and a rear face 59 of the screen wall 54. The front face may extend diagonally downwards from front to back, as far as the rear face 59, and the side walls 57, 58 may extend diagonally towards one another from front to back, as far as the rear face 59.

What is claimed is:

1. An appliance (1) for showering and bathing, the appliance (1) comprising:

a tub (2) for standing on a floor (4), the tub (2) having a fixed reclining and/or sitting surface (5) for a user (P), the tub (2) having a door opening (6) through which the user (P) can move to or from the reclining and/or sitting surface (5), a door (7) for sealing the door opening (6) when the user (P) is in the tub (2), and a screen wall (54) for at least partially enclosing legs (38, 39, 40, 41) upon which the tub (2) stands, the reclining and/or sitting surface (5) being situated at a height (H) above the floor (4) that is the same, or substantially the same, as the normal height (H) of a seat surface (8) of a chair (9*a*) or of a piece of transportation equipment (9*b*), the door (7) being arranged so as to be swung upwards or removed from the tub (2) in order to open the door opening (6), the screen wall (54) defining a space (11) for legs of the user (P) under the reclining and/or sitting surface (5), the legs of the user (P) being positioned in the space (11) when the user (P) is seated on the reclining and/or sitting surface (5), thereby enabling feet of the user (P) to be located on the floor (4) beneath the reclining and/or sitting surface (5), the space (11) extending along at least substantial parts of an underside (16) of the door opening (6), the door opening (6) and the door (7) incorporating undersides (16, 19), the undersides (16, 19) being straight or substantially straight, the underside (16) of the door opening (6) being arranged horizontally or substantially horizontally, the reclining and/or sitting surface (5) of the tub (2) being a flat plane or substantially a flat plane lying horizontally or substantially horizontally, the underside (16) of the door opening (6) and the reclining and/or sitting surface (5) of the tub (2) being situated at the same, or substantially the same, level above the floor (4).

2. The appliance (1) according to claim 1, characterized in that the piece of transportation equipment (9*b*) is a wheelchair or patient trolley that can be wheeled to and from the tub (2) with the user (P) sitting on the seat surface (8), thereby enabling the user (P) to move between the two surfaces (5, 8) situated on the same or substantially the same plane when the user moves between the transportation equipment (9*b*) and the tub (2).

3. The appliance (1) according to claim 1, characterized in that the reclining and/or sitting surface (5) of the tub (2) is arranged at a height (H) above the floor (4) such that the user (P), standing on the floor (4), may sit down backwards onto the reclining and/or sitting surface (5) and thereafter may lift legs onto the reclining and/or sitting surface (5) by raising the legs and twisting the body of the user (P).

4. The appliance (1) according to claim 1, characterized in that, when the door opening (6) is opened, the space (11) beneath the door opening (6) and the reclining and/or sitting surface (5) is not blocked by the door (7) thereby allowing the user (P) to more easily raise himself or herself from the sitting position.

5. The appliance (1) according to claim 4, characterized in that the space (11) is so arranged and configured that the user (P) seated on the reclining and/or sitting surface (5) can place feet onto the floor (4) behind a vertical plane (V) in which a front edge (13) of the reclining and/or sitting surface (5) is situated and/or that the underframe (12) of the transportation equipment (9*b*) can be maneuvered into the space (11) so that the underframe (12) is situated partly behind the vertical plane (V).

6. The appliance (1) according to claim 4, characterized in that the space (11) extends from the floor (4) to the reclining and/or sitting surface (5).

7. The appliance (1) according to claim 1, characterized in that an internal width of a head end (HA) of the tub (2) is greater than an internal width of a foot end (F) of the tub (2).

8. The appliance (1) according to claim 4, characterized in that the space (11) is rectangular or substantially rectangular, when viewed from the side of the appliance (1).

9. The appliance (1) according to claim 4, characterized in that the screen wall (54) incorporates a well (55) which projects rearwards towards the underframe (12) and constitutes the space (11).

10. The appliance (1) according to claim 9, characterized in that the space (11) constituted by the well (55) of the screen wall (54) tapers towards the rear of the tub (2).

11. The appliance (1) according to claim 10, characterized in that the well (55) has an upper face (56), two side walls (57, 58) arranged opposite one another, and a rear face (59), the upper face (56) of the well (55) running diagonally downwards from front to back as far as the rear face (59), the side walls (57, 58) of the well (55) running diagonally towards one another from front to back as far as the rear face (59).

12. The appliance (1) according to claim 1, characterized in that the tub (2) is designed for allowing the user (P) to shower and/or bathe in a sitting position.

13. The appliance (1) according to claim 1, characterized in that the tub (2) has a maximum length of 1600 mm±20% and a maximum width of 700 mm±20%, upper parts of the door opening (6) and the door (7) having a maximum length of 1200 mm±20% the door opening (6) and the door (7) being shorter at the bottom than at the top, the door opening (6) and the door (7) having a maximum height of 450 mm±20%.

14. The appliance (1) according to claim 1, characterized in that the reclining and/or sitting surface (5) is arranged at a height of 450 mm±20% above the floor (4), and the tub (2) having an overall height of 900 mm±20% from the floor (4) to the top edges (37) of the tub (2).

15. The appliance (1) according to claim 1, characterized in that the tub (2) is made of a polymer material.

16. The appliance (1) according to claim 1, characterized in that the space (11) is positioned between two legs (38, 39) of a stand (3) for the tub (2) when viewed from a side of the appliance (1).

17. The appliance (1) according to claim 16, characterized in that the stand (3) has legs (38–41) with adjustable feet (46) for enabling the height (H) of the tub (2) above the floor (4) to be adjusted.

18. The appliance (1) according to claim 1, characterized in that the tub (2) incorporates no devices for supplying water.

19. The appliance (1) according to claim 1, characterized in that the tub (2) is designed for allowing the user (P) to shower and/or bathe in a lying position.

20. An appliance (1) for showering and bathing, the appliance (1) comprising:

a tub (2) for standing on a floor (4), the tub (2) incorporating a reclining and/or sitting surface (5) for a user (P), the tub (2) incorporating a door opening (6) through which the user (P) can move to or from the reclining and/or sitting surface (5), a door (7) for sealing the door opening (6) when the user (P) is in the tub (2), and a screen wall (54) for at least partially enclosing legs (38, 39, 40, 41) upon which the tub (2) stands, the screen wall (54) defining a space (11) extending along at least substantial parts of an underside (16) of the door opening (6), the door opening (6) having a first short side (14) located in proximity to a head end (HA) of the tub (2), the door opening (6) having a second short side (15) located in proximity to a foot end (F) of the tub (2), the door (7) having a first short side (17) cooperating with the first short side (14) of the door opening (6) when the door (7) seals the door opening (6), the door (70 having a second short side (18) cooperating with the second short side (15) of the door opening (6) when the door (7) seals the door opening (6), the first short side (14) of the door opening (6) being in the shape of an arc whose center (C) lies in a horizontal plane (HP2) above the tub (2), the first short side (17) of the door (7) being in the shape of an arc which conforms to the shape of the first short side (14) of the door opening (6), the door opening (6) and the door (7) incorporating undersides (16, 19), the undersides (16, 19) being straight or substantially straight, the underside (16) of the door opening (6) being arranged horizontally or substantially horizontally, the reclining and/or sitting surface (5) of the tub (2) being a flat plane or substantially a flat plane lying horizontally or substantially horizontally, the underside (16) of the door opening (6) and the reclining and/or sitting surface (5) of the tub (2) being situated at the same, or substantially the same, level above the floor (4).

21. The appliance (1) according to claim 19, characterized in that the door (7) swings vertically upwards about a horizontal shaft (10) from a bottom position (A) for sealing the door opening (6) to a top position (B) for opening the door opening (6).

22. The appliance (1) according to claim 21, characterized in that a counterbalancing mechanism (34) exerts a counterbalancing action on the door (7), the counterbalancing mechanism (34) comprising at least one gas-operated spring.

23. The appliance (1) according to claim 20, the door (7) being swingable on a horizontal shaft (10), the horizontal shaft (10) being disposed in proximity to the second short side (15) of the door opening (6), the first short side (14) of the door opening (6) being in the shape of an arc whose center (C) lies in a second horizontal plane (HP2) situated above a first horizontal plane (HP1), the horizontal shaft (10) being located in the first horizontal plane (HP1).

24. The appliance (1) according to claim 20, characterized in that a first corner (20) of the door opening (6), between the first short side (14) of the door opening (6) and an underside (16) of the door opening (6), is in the shape of an arc with a radius (R) within the 50 to 150 mm range, a corresponding corner (21) of the door (7), between the second short side (18) of the door (7) and an underside (19) of the door (7), is in the shape of an arc with a radius (R) conforming to the radius (R) of the first corner (20) of the door opening (6).

25. The appliance (1) according to claim 24, characterized in that the arc shape of the first corner (20) of the door opening (6) has a radius (R) of 85 mm or substantially 85 mm.

26. The appliance (1) according to claim 20, characterized in that a second corner (22) of the door opening (6), between the second short side (15) of the door opening (6) and an underside (16) of the door opening (6), is in the shape of an arc with a radius (R1) within the 50 to 150 mm range, a corresponding second corner (23) of the door (7), between the second short side (18) of the door (7) and an underside (19) of the door (7), is in the shape of an arc with a radius conforming to the radius (R1) of the second corner (22) of the door opening (6).

27. The appliance (1) according to claim 26, characterized in that the arc shape of the second corner (22) of the door opening (6) has a radius (R1) of 85 mm or substantially 85 mm.

28. The appliance (1) according to claim 20, characterized in that an angle ($\alpha$) between the second short side (15) of the door opening (6) and a vertical plane (VI) is 15 degrees or less, the corresponding second short side (18) of the door (7) forming a corresponding angle ($\alpha$) with the vertical plane (VI).

29. The appliance (1) according to claim 28, characterized in that the angle ($\alpha$) between the second short side (15) and the vertical plane (VI) is 5 degrees or substantially 5 degrees.

30. The appliance (1) according to claim 20, characterized in that the door (7) incorporates a door leaf of sandwich-type construction, the door leaf having three layers (24, 25 and 26), two outer layers (24, 26) made of reinforced plastic and, arranged between the outer layers (24, 26) an inner layer (25) made of polyurethane foam.

31. The appliance (1) according to claim 20, characterized in that the door (7) has an overall weight of 8 kg or less.

32. The appliance (1) according to claim 20, characterized in that, at least on the first and second short side (14, 15), parts (27) of the door opening (6), when the door (7) seals the door opening (6), interact with parts (28, 29) on at least the first and second short sides (17, 18) of the door (7) such that the parts (27, 28, 29) prevent the door (7) from being pressed out of the door opening (6) when the door (7) is under load from liquid in the tub (2).

33. The appliance (1) according to claim 32, characterized in that the parts (27, 28, 29) bear tightly against one another when the door (7) seals the door opening (6), thereby creating a liquid-tight or substantially liquid-tight joint between the door (7) and the tub (2).

34. The appliance (1) according to claim 32, characterized in that the parts (27) of the door opening (6) comprise a channel (27), the parts (28, 29) of the door (7) comprising a channel (28) and a sealing strip (29) engaged by the channel (28), the door (7) and the sealing strip (29) engaging the channel (27) of the door opening (6) when the door (7) seals the door opening (6), the sealing strip (29) bearing tightly against sides of the channel (27) of the door opening (6).

35. The appliance (1) according to claim 32, characterized in that an underside (19) of the door (7) comprises parts (28, 29) for cooperating with flat or substantially flat parts (27) of an underside (16) of the door opening (6) in a manner that produces a tight joint between the undersides (19, 16) of the door opening (6) and the door (7) without liquid collecting a channel in the underside (16) of the door opening (6).

36. The appliance (1) according to claim 20, characterized in that the door opening (6) and the door (7) have substantially the form of a parallelepipedon.

37. The appliance (1) according to claims 20, characterized in that a locking device (30) locks the door (7) in relation to the tub (2) when the door (7) seals the door opening (7), the locking device (30) exerting a pressure on sealing strips disposed between the door (7) and the tub (2).

* * * * *